US008562174B2

(12) United States Patent
Pickholz

(10) Patent No.: US 8,562,174 B2
(45) Date of Patent: Oct. 22, 2013

(54) LAMP ASSEMBLY AND METHOD FOR MAKING

(76) Inventor: Michael Pickholz, Oxford, MI (US)

( * ) Notice: Subject to any disclaimer, the term of this patent is extended or adjusted under 35 U.S.C. 154(b) by 0 days.

(21) Appl. No.: 13/321,883

(22) PCT Filed: Jun. 30, 2010

(86) PCT No.: PCT/US2010/037260
§ 371 (c)(1),
(2), (4) Date: Mar. 2, 2012

(87) PCT Pub. No.: WO2010/141721
PCT Pub. Date: Dec. 9, 2010

(65) Prior Publication Data

US 2012/0162983 A1 Jun. 28, 2012

Related U.S. Application Data

(60) Provisional application No. 61/275,702, filed on Jun. 3, 2009.

(51) Int. Cl.
*F21V 1/00* (2006.01)

(52) U.S. Cl.
USPC ..... 362/235; 362/257; 362/294; 362/311.01; 362/373

(58) Field of Classification Search
USPC ..... 362/235, 244–245, 249.01–249.02, 362/257, 294, 296.01, 311.01–311.02, 326, 362/341, 373, 800; 29/592.1
See application file for complete search history.

(56) References Cited

U.S. PATENT DOCUMENTS

| | | | |
|---|---|---|---|
| 5,633,629 | A | 5/1997 | Hochstein |
| 5,782,555 | A | 7/1998 | Hochstein |
| 5,783,909 | A | 7/1998 | Hochstein |
| 5,784,006 | A | 7/1998 | Hochstein |
| 5,785,418 | A | 7/1998 | Hochstein |
| 5,857,767 | A | 1/1999 | Hochstein |
| 6,045,240 | A | 4/2000 | Hochstein |
| 6,428,189 | B1 | 8/2002 | Hochstein |
| 6,443,592 | B1 | 9/2002 | Unger |
| 6,517,218 | B2 | 2/2003 | Hochstein |
| 6,582,100 | B1 | 6/2003 | Hochstein |
| 7,824,076 | B2 | 11/2010 | Koester |
| 8,109,660 | B2 | 2/2012 | Hochstein |
| 2001/0046139 | A1 | 11/2001 | Hashigaya |

(Continued)

FOREIGN PATENT DOCUMENTS

AU 2008100403 12/2008

OTHER PUBLICATIONS

International Magnesium Association, "Planes, Trains and Motorcycles . . . Magnesium Accelerates Smart Weighting Trend", Mg Showcase, Apr. 2009, pp. 1-4, Issue 8.

(Continued)

*Primary Examiner* — Stephen F Husar
*Assistant Examiner* — Meghan Dunwiddie
(74) *Attorney, Agent, or Firm* — Dickinson Wright PLLC

(57) ABSTRACT

A lamp assembly, comprising a lens, a lamp housing in the form of an integral metal part, the lamp housing cooperating with the lens to at least partially define a lamp chamber that is generally fluidly isolated from an ambient atmosphere outside the lamp chamber, and at least one lamp provided in the lamp chamber and carried by the lamp housing. The lamp housing itself defines a heat sink exposed to the ambient atmosphere outside the lamp chamber such that heat from the at least one lamp is transmitted to the ambient atmosphere.

4 Claims, 10 Drawing Sheets

(56) References Cited

U.S. PATENT DOCUMENTS

| | | | |
|---|---|---|---|
| 2002/0015310 | A1 | 2/2002 | Pickholz |
| 2005/0190572 | A1 | 9/2005 | Komatsu |
| 2007/0047229 | A1 | 3/2007 | Lee |
| 2007/0058387 | A1 | 3/2007 | Takada |
| 2007/0076413 | A1 | 4/2007 | Mingozzi |
| 2007/0115656 | A1 | 5/2007 | Chou et al. |
| 2007/0127252 | A1 | 6/2007 | Fallahi |
| 2008/0123334 | A1 | 5/2008 | Hochstein |
| 2008/0175003 | A1 | 7/2008 | Tsou et al. |
| 2009/0003009 | A1 | 1/2009 | Tessnow |
| 2009/0223047 | A1 | 9/2009 | Hochstein |
| 2010/0020548 | A1 | 1/2010 | Tyson |
| 2011/0038170 | A1 | 2/2011 | Kracker |
| 2011/0053492 | A1 | 3/2011 | Hochstein |
| 2011/0110087 | A1 | 5/2011 | Hochstein |
| 2011/0114976 | A1 | 5/2011 | Hochstein |
| 2011/0122616 | A1 | 5/2011 | Hochstein |
| 2011/0140140 | A1 | 6/2011 | Hochstein |
| 2011/0273879 | A1 | 11/2011 | Hochstein |
| 2012/0069571 | A1 | 3/2012 | Hochstein |
| 2012/0147603 | A1 | 6/2012 | Hochstein |

OTHER PUBLICATIONS

"SureFire Maximus 500 Lumens Rechargeable LED Head Light," http://www.opticsplanet.com/surefire-maximus-500-lumens-rechargeable-led-head-light-bl, retrieved from Internet Jul. 10, 2013.

FIG. 8A
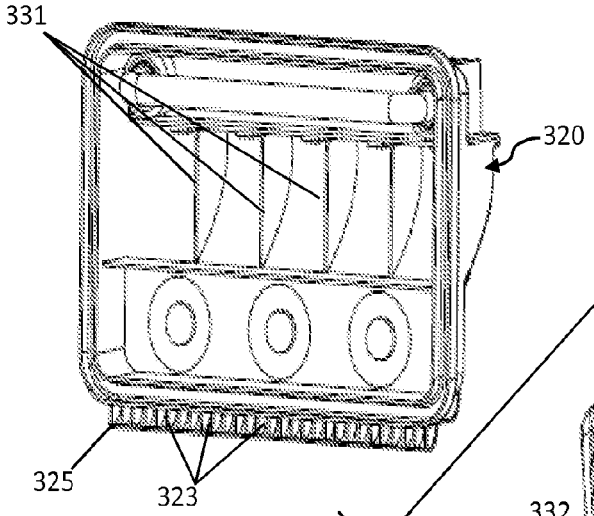
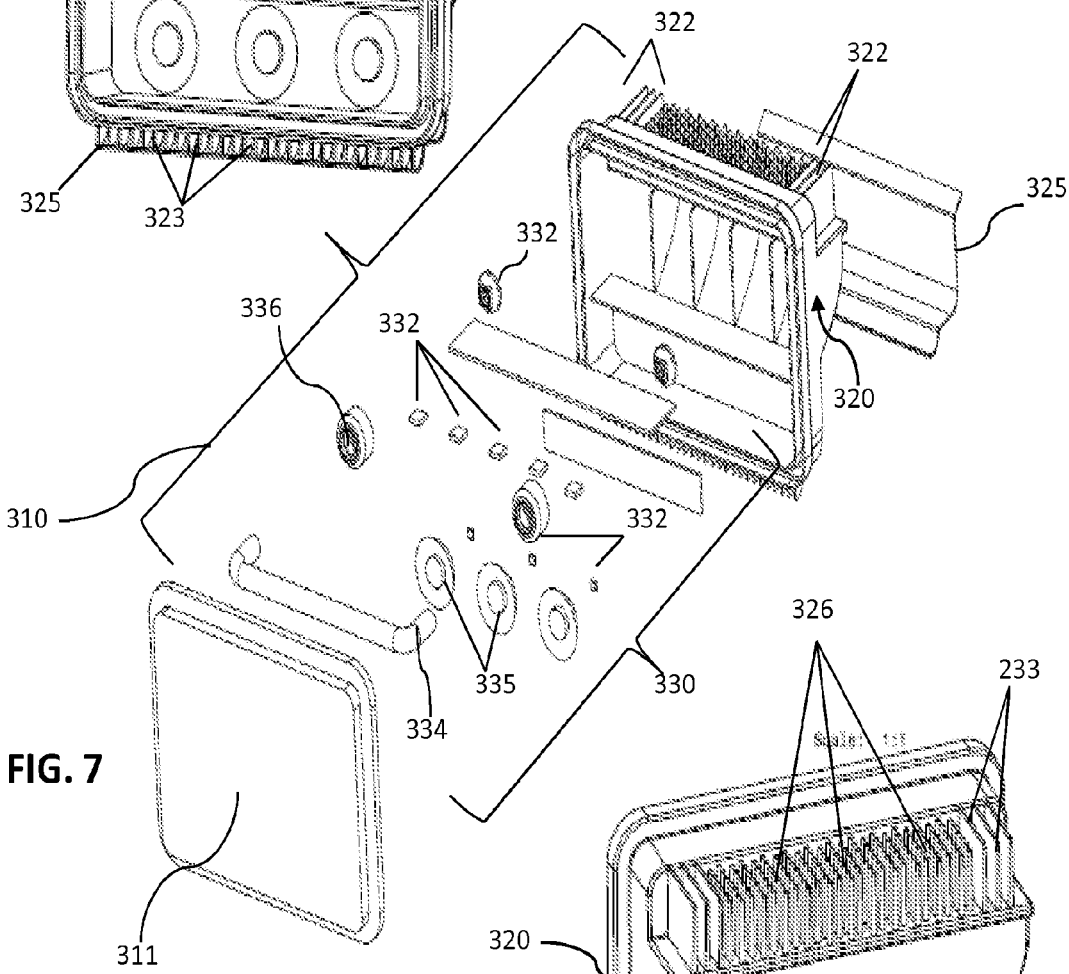
FIG. 7
FIG. 8B

LAMP ASSEMBLY AND METHOD FOR MAKING

CROSS-REFERENCE TO RELATED APPLICATIONS

This application is related to, and claims the benefit of priority from, U.S. patent application Ser. No. 12/455,568, filed 3 Jun. 2009, the disclosure of which is incorporated herein by reference in its entirety.

TECHNICAL FIELD

This invention relates generally to a lamp assembly for dissipating the heat generated by one or more lamps provided in a generally fluidly sealed chamber of the lamp assembly.

BACKGROUND OF THE INVENTION

LED lamp applications, including those comprising high-powered LEDs, are being developed at an increasing rate. LEDs, unlike more conventional light sources such as tungsten, halogen or HID light sources, emit essentially no infrared radiation and are, therefore, "cold" on their optical output side. Nevertheless, LEDs do generate heat at their electrical junction, the so-called "back side," of the LED proper. This is particularly significant as the drive current increases in order to achieve greater LED optical output. Control of this thermal output, referred to as "junction temperature," is critical so as to ensure proper operating performance of the LED and avoid either premature degradation or failure.

With the "back side" of the LEDs being housed within the lamp housing, which housing is conventionally made primarily of plastic, the heat generated is "trapped" within the housing. This thermal output on the "back side" of LEDs must be removed in order to prevent overheating and, relatedly, premature failure of the LED lamp. Accordingly, LEDs do require cooling via the introduction of heat sinks.

Conventionally, it is the practice to place such heat sinks within the housing of the LED lamp, where the LEDs themselves are housed. For instance, the head and tail-lamps for the CADILLAC CTS brand automobile utilize a single, high-power LED and a die-cast heat sink that dissipates heat within the housing of the lamp. Given that there is, for these particular applications, a sufficient amount of interior volume in which to dissipate this energy, such heat sinks serve their purpose. However, either for smaller volumes or applications generating additional thermal input, adequate dissipation of heat internally is complicated, thereby forcing the adoption of more elaborate thermal management solutions, such as exposing the heat sink to the outside of the housing or utilizing "heat pipes" (liquid filled thermal conductors) or cooling fans to circulate air within the lamp housing.

Still another solution, disclosed in United States Patent Application Pub. No. US 2007/0127252 A1 to Fallahi et al., published Jun. 7, 2007, comprises an LED headlamp assembly for a motor vehicle having a plastic lens and a plastic lamp housing cooperating with the lens to define an inner chamber that is generally fluidly isolated from the atmosphere. A cast metal reflector is mounted to the lamp housing and has a polished reflective portion that reflects light forward through the lens. A separate heat sink portion of the reflector includes fins that extend through the lamp housing and are exposed to the atmosphere outside the lamp housing, such that heat from the inner chamber is transmitted from the fins to the atmosphere.

The foregoing thermal management solutions notwithstanding, it is desirable to have a lamp assembly, for automotive as well as other applications, that is able to effectively dissipate heat energy generated by LEDs or other light sources.

SUMMARY

The specification discloses a lamp assembly comprising a lens, a lamp housing in the form of an integral metal part, the lamp housing cooperating with the lens to at least partially define a lamp chamber that is generally fluidly isolated from an ambient atmosphere outside the lamp chamber, and at least one lamp provided in the lamp chamber and carried by the lamp housing. The lamp housing itself defines a heat sink exposed to the ambient atmosphere outside the lamp chamber such that heat from the lamp is transmitted to the ambient atmosphere.

The heat sink defined by the lamp housing may further include radiating elements that are exposed to the ambient atmosphere outside the lamp chamber such that heat from the lamp is transmitted to the ambient atmosphere through the radiating elements. In one embodiment of the invention, these radiating elements comprise fins that are exposed to the ambient atmosphere outside the lamp chamber such that heat from the lamp is transmitted to the ambient atmosphere through the fins. In another embodiment, these radiating elements comprise pins that are exposed to the ambient atmosphere outside the lamp chamber such that heat from the lamp is transmitted to the ambient atmosphere through the pins.

In another embodiment, the heat sink defined by the lamp housing further includes one or more ducts configured to promote passive convective cooling. These one or more ducts may be formed integrally with the lamp housing or, alternatively, may be defined in a separate baffle that is secured to the lamp housing. Per one feature of the invention, each of the one or more ducts is formed using internal mold slides and lifters.

According to one feature of the invention, the at least one lamp includes a reflector portion positioned and configured to reflect light emitted by the at least one lamp forward through the lens. The reflector portion may include a polished surface.

Per another feature, the at least one lamp comprises an LED. The at least one. LED may, per a further feature, be of the type connected to a circuit board including current paths connected to leads of the at least one LED and connectable to a source of electrical power operative to power the LED. According to this feature, the circuit board is connected to the lamp housing.

Per a further feature, the lamp housing is formed as a single, unitary—or monolithic—metal piece.

The lamp housing may be formed, by way of non-limiting example, from one or more materials selected from the group of materials consisting of stainless steel, low alloy steel, tool steel, titanium, cobalt, copper, magnetic metal, hard-metal, refractory metal, ceramic, magnesium, aluminum, and magnesium/aluminum alloy.

The lamp housing may, according to another feature of the invention, be formed by the process of metal injection molding, including the sub-technique of thixoforming.

The lamp housing may, according to another feature of the invention, be combined with extension, or supplemental housings, which may optionally be made from dissimilar materials such as plastics and thermosets.

According to yet another feature, the lamp housing carries a plurality of lamps.

Per still another feature of the present invention, the lens is secured to the lamp housing by one or more bonding agents selected from the group consisting of butyl and silicone-based sealants. Alternatively, the lens may be secured to the lamp housing mechanically and sealed via the incorporation of a gasket or sealing device.

The specification also discloses a method for making a lamp assembly, the method including the steps of:

making a lamp housing as an integral metal part;

mounting at least one lamp in the lamp housing; and mounting a lens on the lamp housing such that the lens cooperates with the lamp housing to at least partially define a lamp chamber that encloses the lamp, the lamp chamber being generally fluidly isolated from an ambient atmosphere outside the lamp chamber.

According to the foregoing method, the lamp housing defines a heat sink exposed to the ambient atmosphere outside the lamp chamber such that heat from the lamp is transmitted to the ambient atmosphere.

Per one feature of the invention, the step of making the lamp housing further comprises making the lamp housing a single, unitary—or monolithic—metal piece.

According to another feature, the step of making the lamp housing comprises making the lamp housing by the process of metal injection molding, including the sub-technique of thixoforming.

Per a still further feature, the step of mounting at least one lamp in the lamp housing includes providing a reflector portion in the lamp housing in a position to reflect light emitted by the at least one lamp forward through the lens. Alternatively, or in addition, optical lenses, such as TIR ("Total Internal Refraction") lenses, may be employed.

Per yet another feature, the step of mounting at least one lamp in the lamp housing comprises mounting at least one LED in the housing.

According to a further feature of the invention, the at least one LED is connected to a circuit board including current paths connected to leads of the at least one LED and connectable to a source of electrical power operative to power the LED, the circuit board being mounted in the lamp housing.

The heat sink defined by the lamp housing may include radiating elements that are exposed to the ambient atmosphere outside the lamp chamber such that heat from the lamp is transmitted to the ambient atmosphere through the radiating elements. In one embodiment of the invention, these radiating elements comprise fins that are exposed to the ambient atmosphere outside the lamp chamber such that heat from the lamp is transmitted to the ambient atmosphere through the fins.

In another embodiment, the heat sink defined by the lamp housing includes one or more ducts configured to promote passive convective cooling. In another embodiment, the heat sink defined by the lamp housing includes a one or more ducts configured to promote passive convective cooling. Per one feature of the invention, each of the one or more ducts is formed using internal mold slides and lifters.

BRIEF DESCRIPTION OF THE DRAWINGS

For a better understanding of the present invention and to show more clearly how it may be carried into effect, reference will now be made, by way of example, to the accompanying drawings, in which:

FIG. 7 is an exploded perspective view of a lamp assembly according to a fourth embodiment of the present invention;

FIG. 8A is a frontal perspective view of a lamp assembly according to the embodiment of FIG. 7;

FIG. 8B is a rear perspective view of the lamp assembly of FIG. 8A;

DETAILED DESCRIPTION

As required, a detailed description of exemplary embodiments of the present invention are disclosed herein. However, it is to be understood that the disclosed embodiments are merely exemplary of the invention, which may be embodied in various and alternative forms. The accompanying drawings are not necessarily to scale, and some features may be exaggerated or minimized to show details of particular components. Therefore, specific structural and functional details disclosed herein are not to be interpreted as limiting, but merely as a providing a representative basis for teaching one skilled in the art to variously employ the present invention.

Figure 2B:
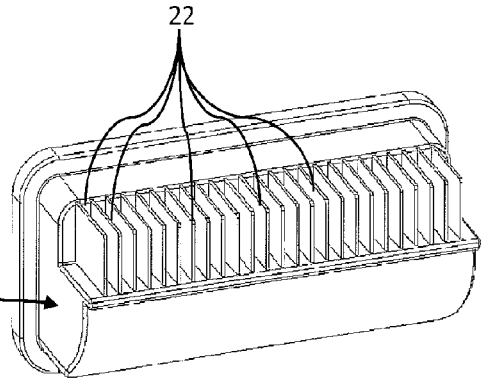
FIG. 2B is a rear perspective view of the lamp assembly of FIG. 2A.
Figure 2A:
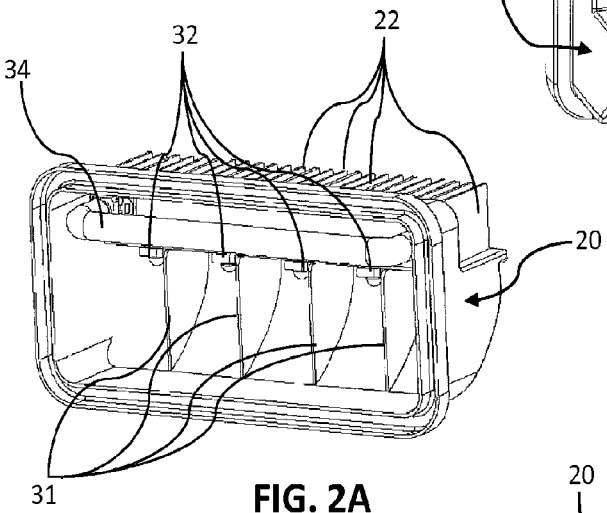
FIG. 2A is a frontal perspective view of the lamp assembly according to the embodiment of FIG. 1.
Figure 1:
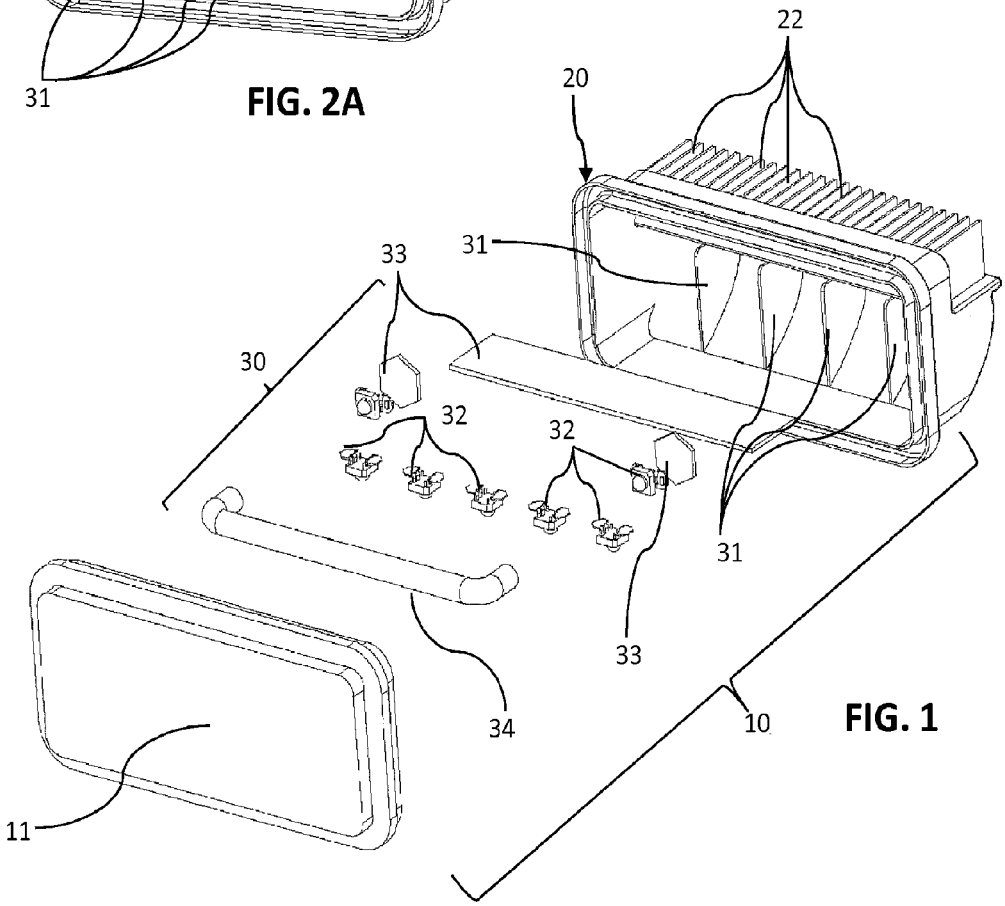
FIG. 1 is an exploded perspective view of a lamp assembly according to a first embodiment of the present invention.
Figure 2F:
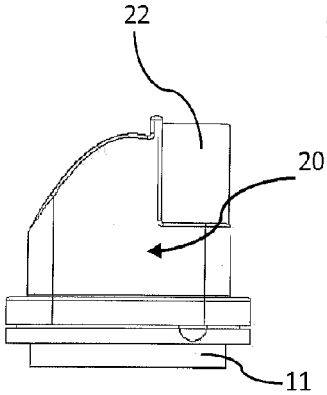
FIG. 2F is a left-side view of the lamp assembly of FIG. 2A.
Figure 2C:
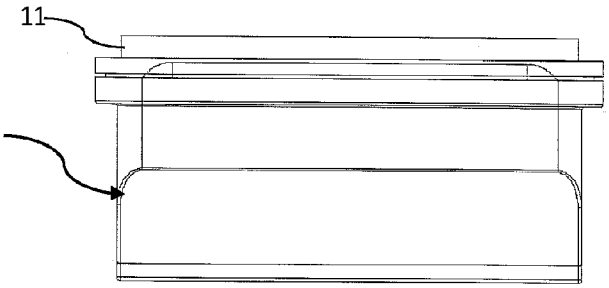
FIG. 2C is a bottom view of the lamp assembly of FIG. 2A.
Figure 2D:
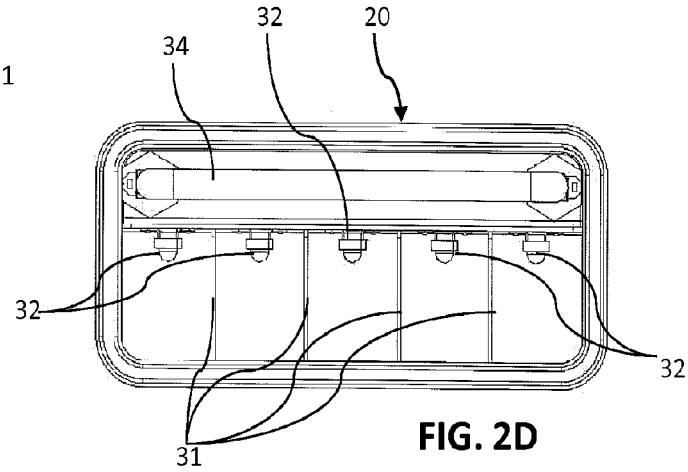
FIG. 2D is a frontal view of the lamp assembly of FIG. 2A.
Figure 2G:
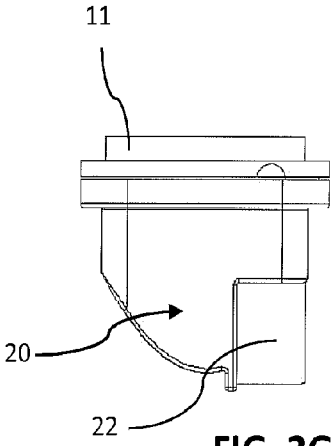
FIG. 2G is a right-side view of the lamp assembly of FIG. 2A.
Figure 2E:
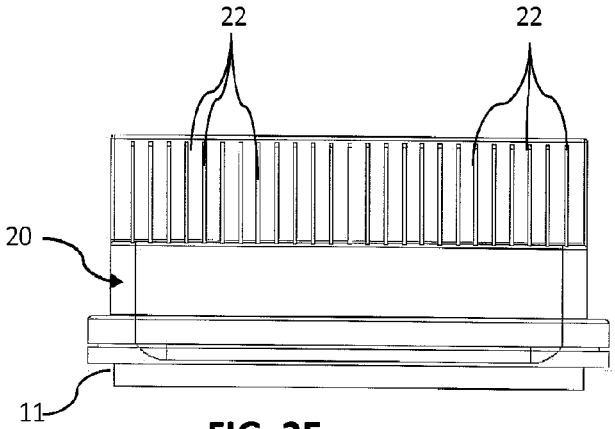
FIG. 2E is a top view of the lamp assembly of FIG. 2A.
Figure 4B:
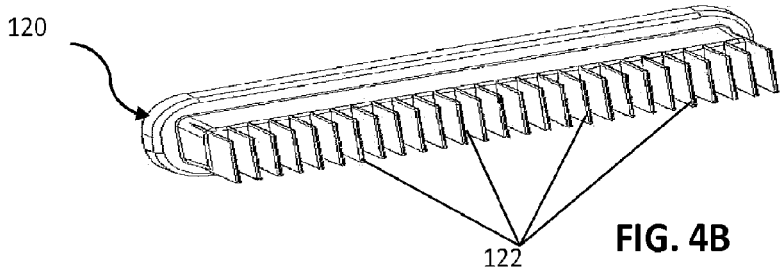
FIG. 4B is a rear perspective view of the lamp assembly of FIG. 4A.
Figure 4A:
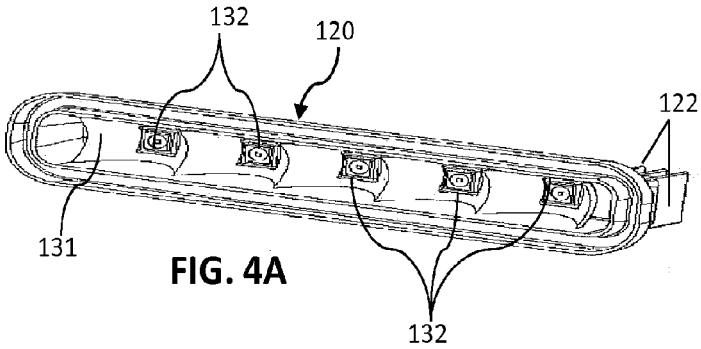
FIG. 4A is a frontal perspective view of the lamp assembly according to the embodiment of FIG. 3.
Figure 3:
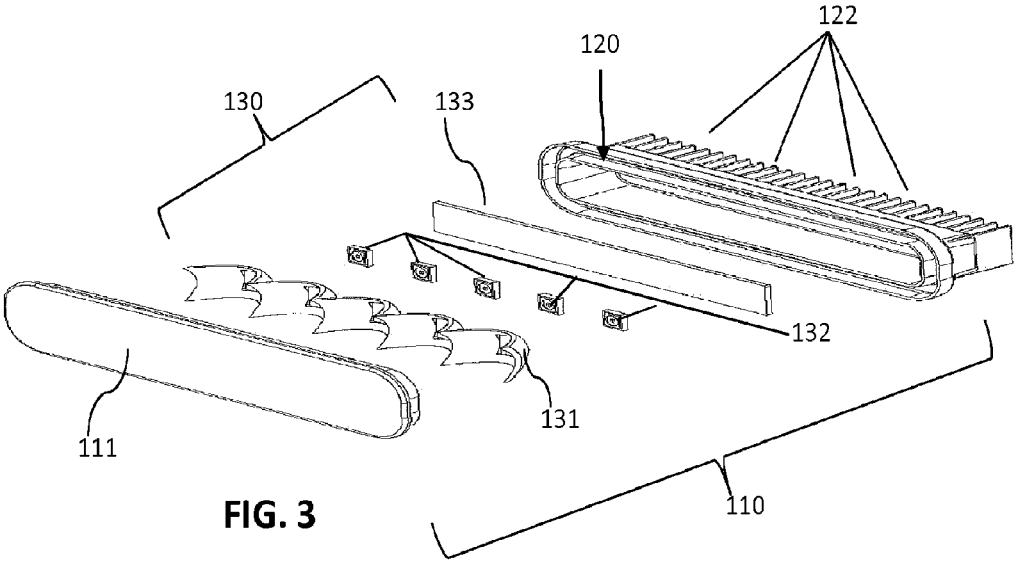
FIG. 3 is an exploded perspective view of a lamp assembly according to a second embodiment of the present invention.
Figure 4C:
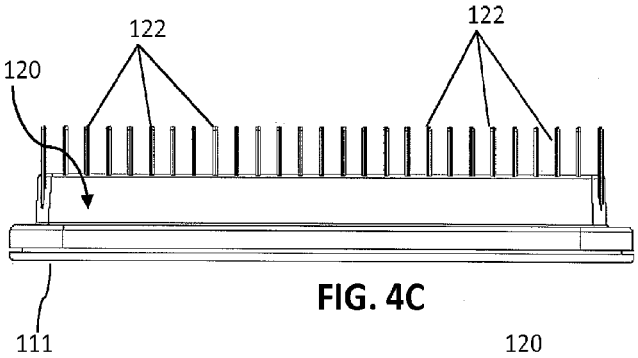
FIG. 4C is a top view of the lamp assembly of FIG. 4A.
Figure 4F:
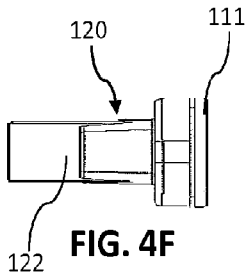
FIG. 4F is a left-side view of the lamp assembly of FIG. 4A.
Figure 4D:
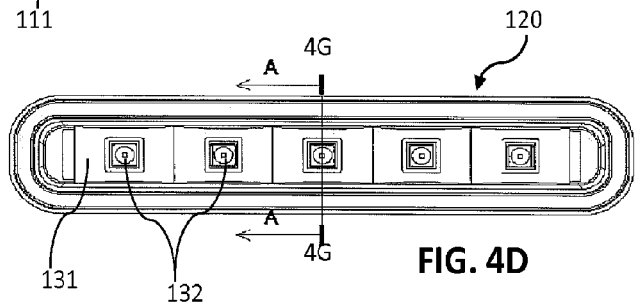
FIG. 4D is a frontal view of the lamp assembly of FIG. 4A.
Figure 4G:
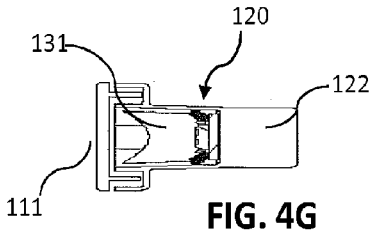
FIG. 4G is a cross-sectional view of the lamp assembly of FIG. 4A.
Figure 4E:
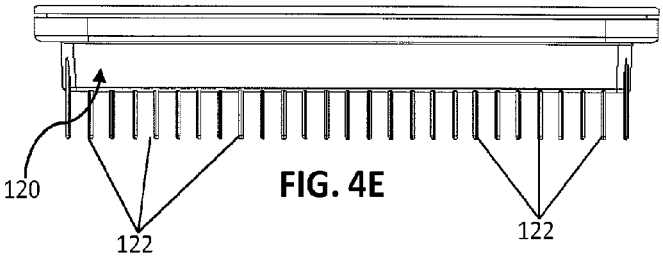
FIG. 4E is a bottom view of the lamp assembly of FIG. 4A.
Figure 4H:
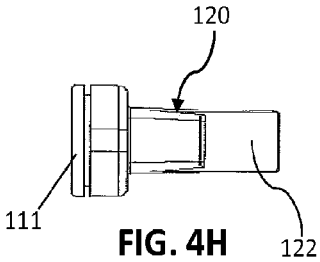
FIG. 4H is a right-side view of the lamp assembly of FIG. 4A.
Figure 6A:
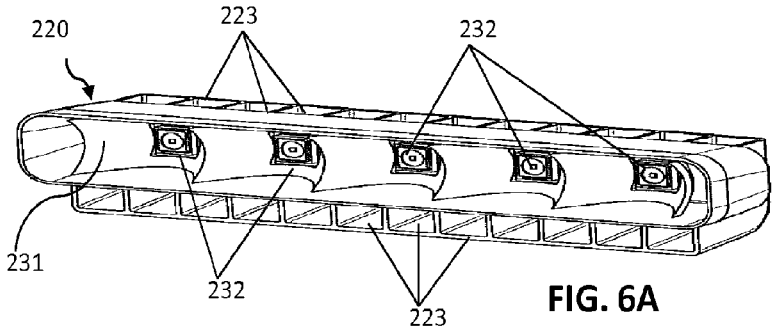
FIG. 6A is a frontal perspective view of a lamp assembly according to the embodiment of FIG. 5.
Figure 6B:
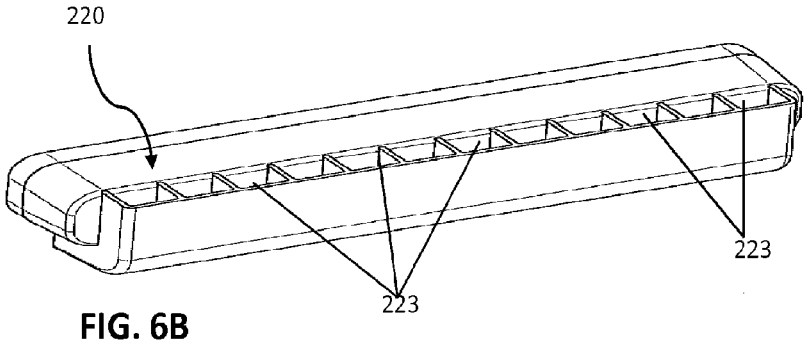
FIG. 6B is a rear perspective view of the lamp assembly of FIG. 6A.

Referring now to the drawings, and more particularly to FIGS. 1 through 2G as exemplary of the invention as shown also in the embodiments of FIGS. 3 through 4H, FIGS. 5 through 6I, FIGS. 7 through 8H, FIGS. 9 through 10B, and FIGS. 11 through 12B the present invention may be seen to essentially comprise a lamp assembly 10 for dissipating heat generated by one or more lamps, the lamp assembly 10 comprising a lens 11, a lamp housing 20 in the form of an integral metal part, and at least one lamp 30. The lamp housing 20 cooperates with the lens 11 to at least partially define a lamp chamber that is generally fluidly isolated from an ambient atmosphere outside the lamp chamber, and it is in this lamp chamber that the at least one lamp 30 is disposed. Furthermore, the lamp housing 20 according to the present invention defines a heat sink exposed to the ambient atmosphere outside the lamp chamber, such that heat from the at least one lamp 30 is transmitted to the ambient atmosphere.

The inventive lamp assembly will be understood by those skilled in the art to have utility in numerous applications, including, without limitation, motor vehicles (including automobiles), and fixed indoor and outdoor (e.g., street lighting, parking garage lighting, etc.) lighting applications.

Unless specified otherwise, the several embodiments of the inventive apparatus as herein described, and shown variously in FIGS. 1 through 2G, FIGS. 3 through 4H, FIGS. 5 through 6I, FIGS. 7 through 8H, FIGS. 9 through 10B, and FIGS. 11 through 12B, are identical in all material respects.

A bonding agent may be disposed between the lens 11 and the lamp housing 20 in a position to adhere the lens to the lamp housing. The bonding agent may also include a sealant to seal the lens to the lamp housing. The bonding agent may include adhesives/sealants such as butyl and silicone based sealants, by way of non-limiting example. In other contemplated embodiments, the bonding agent may include other suitable adhesives and/or sealants known in the art.

It is also envisioned that the lens 11 may be mechanically connected to the lamp housing 20, in which case sealing may be accomplished via a gasket or other sealing device interposed between the lens and lamp housing.

With continuing reference to FIGS. 1 through 2G as exemplary of the invention according to the several embodiments disclosed herein, the lamp housing 20 is an integral metal part formed from one or more materials such as, by way of non-limiting example, stainless steel, low alloy steel, tool steel, titanium, cobalt, copper, magnetic metal, hard-metal, refractory metal, ceramic, magnesium, aluminum, and/or magnesium/aluminum alloy. Preferably, though not necessarily, lamp housing 20 is formed as a single, unitary—or monolithic—metal part. Lamp housing 20 may, as described below, be formed by metal injection molding ("MIM"), including the sub-technique of thixoforming, or other conventional metal forming processes.

The lamp housing 11 may, optionally, be combined with extension or supplemental housings, made from dissimilar materials such as plastics and thermosets, which are joined to the housing 11.

Referring to the particular embodiments of FIGS. 3 through 4H, FIGS. 5 through 6I, and FIGS. 7 through 8H, the at least one lamp 130, 230, 330 may comprise one or more reflector portions 131, 231, 331. In conventional fashion, such one or more reflector portions 131, 231, 331 may be positioned and configured to reflect light emitted by the at least one lamp 130, 230 forward to the lens 111, 211. The one or more reflector portions 131, 231, 331 may, to this end, include a polished surface. Rather than comprising separate elements, it is alternatively contemplated that the one or more reflector portions may be formed on or by a surface of the lamp housing itself, being disposed in a position to reflect light emitted by the lamp forward to the lens, such as shown by the reflector portions 31 in the embodiment of FIGS. 1 through 2G and the reflector portions 331 in the embodiment of FIGS. 7 through 8H. Of course, it is contemplated that a lamp assembly according to any of the embodiments described herein may or may not include one or more reflector portions, as desired.

Each at least one lamp 30, 130, 230, 330 comprises at least one light source, which may take the form of one or more LEDs 32, 132, 232. The LEDs may be connected to one or more circuit boards 33, 133, 233, each including current paths connected to leads of the one or more LEDs and connectable to a source of electrical power (not depicted) that is operative to power the one or more LEDs. The circuit board(s) 33, 133, 233 may be mounted in the lamp chamber of lamp housing 20, 120, 220.

With particular reference to the embodiments of FIGS. 1 through 2G and FIGS. 7 through 8H, the at least one lamp 30, 330 may, optionally and according to user preference, further include one or more of a light pipe 34, 334, reflector optics 336, and/or total internal refraction optics 335.

Still referring to FIGS. 1 through 2G as exemplary of the invention in the several embodiments thereof, the at least one lamp 30 is, as noted, carried by the lamp housing 20 such that the lamp housing 20 both defines the heat sink and carries the at least one lamp 30. The heat sink is exposed to the ambient atmosphere outside the lamp chamber such that heat from the lamp is transmitted to the ambient atmosphere.

With reference being had to the particular embodiments of FIGS. 1 through 2G and FIGS. 3 through 4H, the heat sink defined by lamp housing 20, 120 may, as shown, further include radiating elements, such as the exemplary fins 22, 122, that are exposed to the ambient atmosphere outside the lamp chamber such that heat from the one or more lamps 30, 130 is transferred to the ambient atmosphere through the fins 22, 122. These radiating elements may comprise fins (such as shown in FIGS. 1 through 2G), pins 326 (such as shown in the embodiment of FIGS. 7 through 8H) etc., having any number of geometries and orientations as desired to ensure the sufficient dissipation of heat.

Turning now to the embodiments of FIGS. 5 through 6I and FIGS. 7 through 8H, the heat sink defined by lamp housing 220, 320 may be seen to optionally comprise one or more ducts 223, 323. These ducts 223, 323 are essentially channels which open at opposite ends to communicate with the ambient atmosphere outside of the lamp chamber, and which are shaped and positioned to promote passive convective cooling by using thermal load to generate a chimney effect; that is, convective cooling via a convective flow generated through the thermal output of the LED and channeled via the defined thermal channel and/or ducts.

Figure 8C:
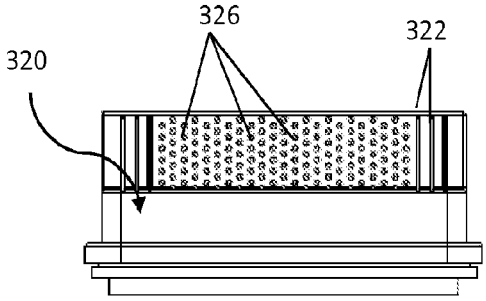
FIG. 8C is a top view of the lamp assembly of FIG. 8A.
Figure 8D:
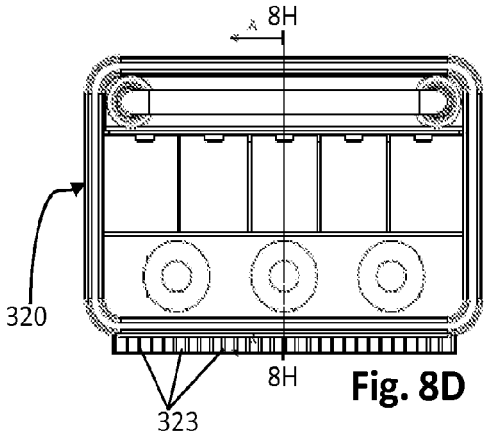
FIG. 8D is a frontal view of the lamp assembly of FIG. 8A.
Figure 8E:
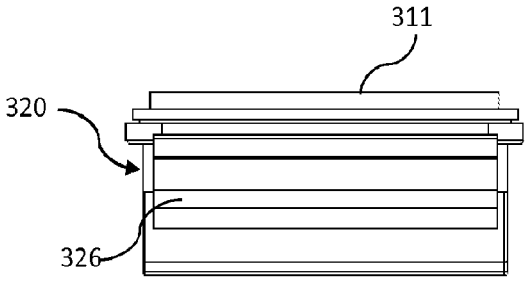
FIG. 8E is a bottom view of the lamp assembly of FIG. 8A.
Figure 8F:
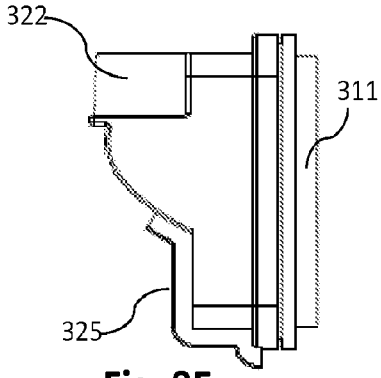
FIG. 8F is a left-side view of the lamp assembly of FIG. 8A.
Figure 8G:
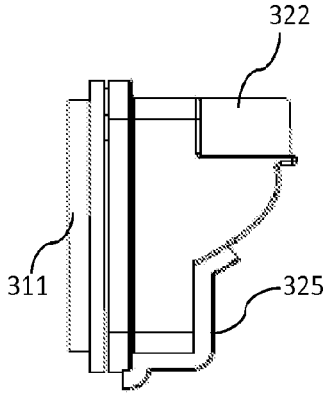
FIG. 8G is a right-side view of the lamp assembly of FIG. 8A.
Figure 8H:
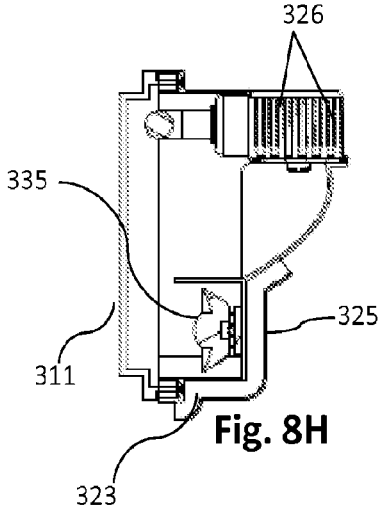
FIG. 8H is a cross-sectional view of the lamp assembly of FIG. 8A.
Figure 9:
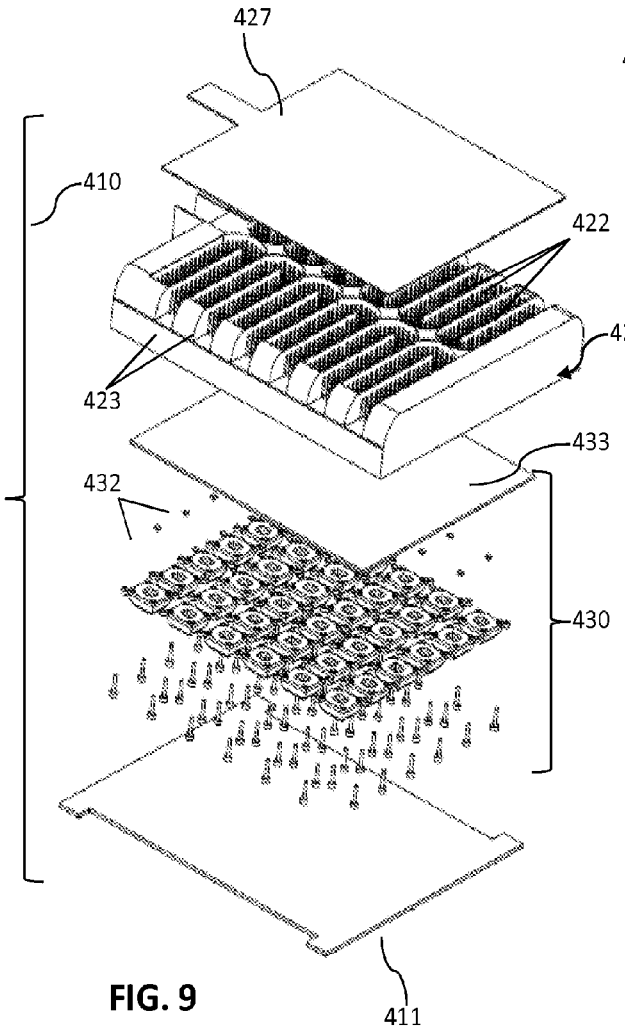
FIG. 9 is an exploded perspective view of a lamp assembly according to a fifth embodiment of the present invention.
Figure 10A:
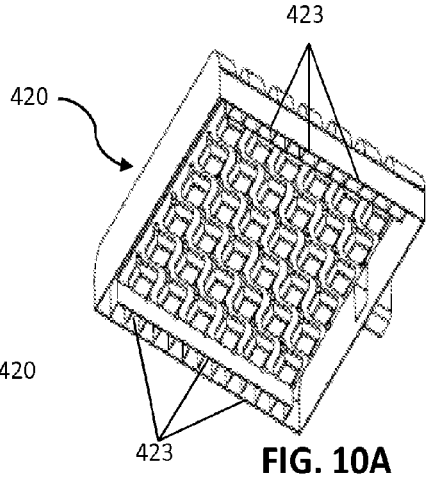
FIG. 10A is a bottom perspective view of the lamp housing of the lamp assembly of the embodiment of FIG. 9.
Figure 10B:
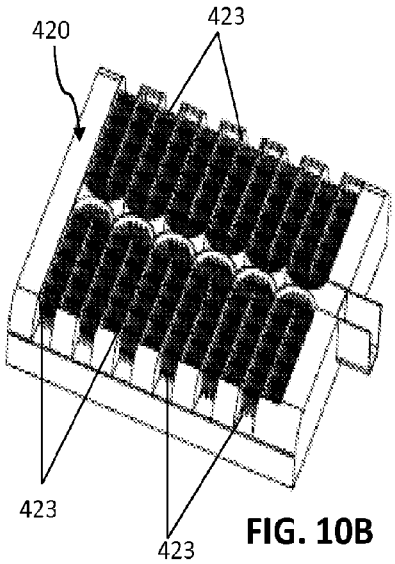
FIG. 10B is a top perspective view of the lamp housing of the lamp assembly of the embodiment of FIG. 10A.
Figure 12A:
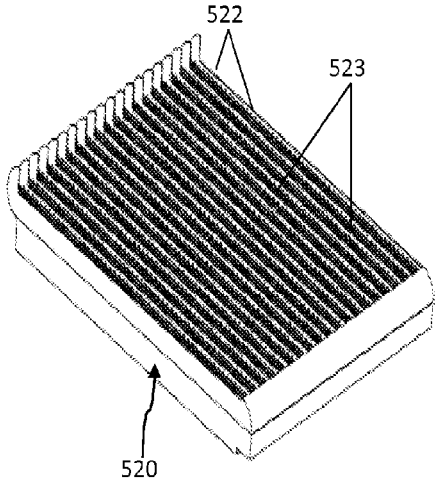
FIG. 12A is a top perspective view of the lamp housing of the lamp assembly of the embodiment of FIG. 11.
Figure 11:
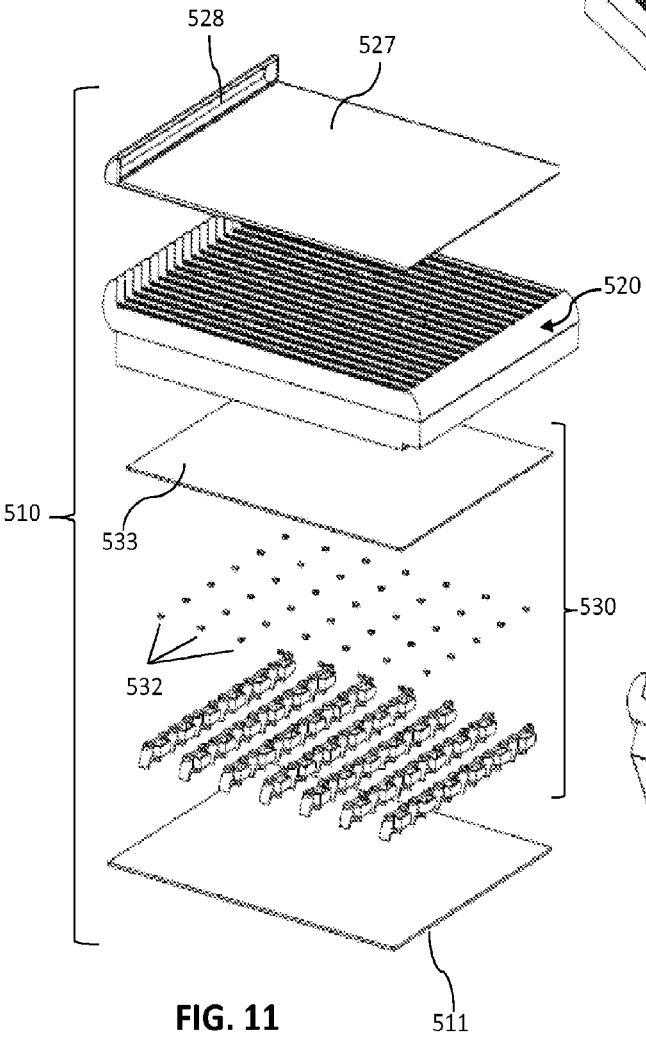
FIG. 11 is an exploded perspective view of a lamp assembly according to a sixth embodiment of the present invention.
Figure 12B:
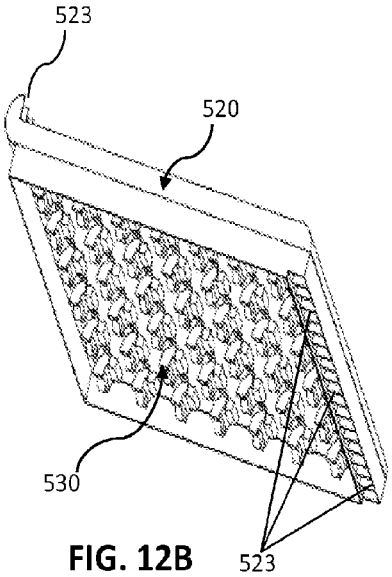
FIG. 12B is a bottom perspective view of the lamp housing of the lamp assembly of the embodiment of FIG. 12A.

While the lamp housing per se of the invention defines a heat sink, it will be appreciated from the embodiment of FIGS. 7 through 8H that the heat sink defined by lamp housing may further optionally comprise any one or more of the foregoing additional radiating elements, such as fins 322 and/or pins 326, and/or ducts 323 as also described heretofore.

Figure 5:
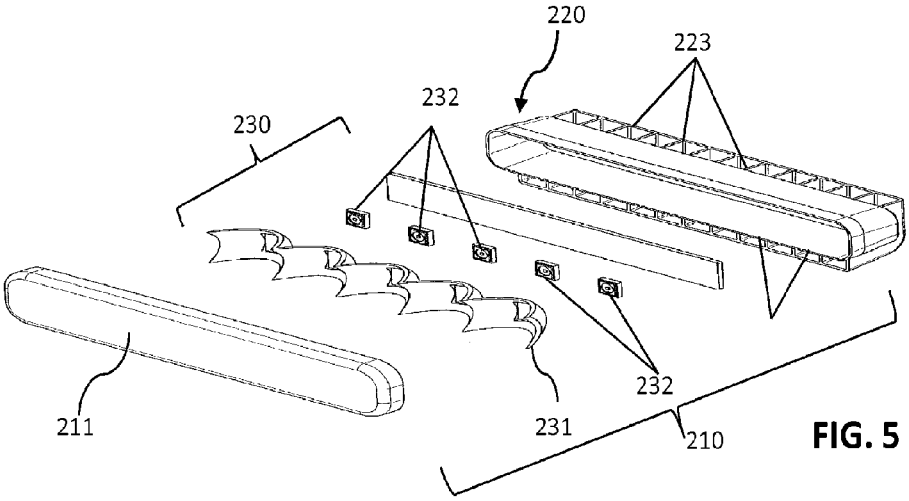
FIG. 5 is an exploded perspective view of a lamp assembly according to a third embodiment of the present invention.
Figure 6C:
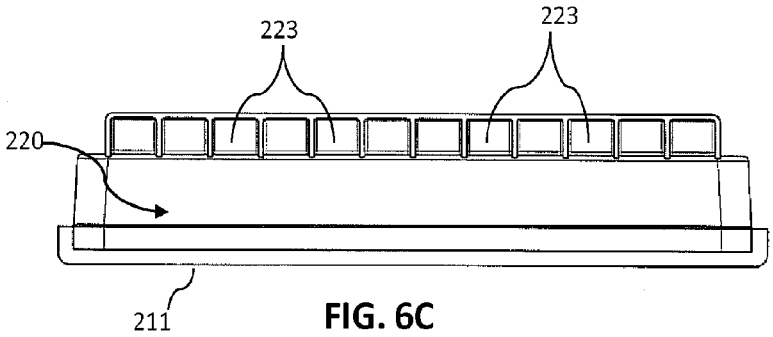
FIG. 6C is a top view of the lamp assembly of FIG. 6A.
Figure 6F:
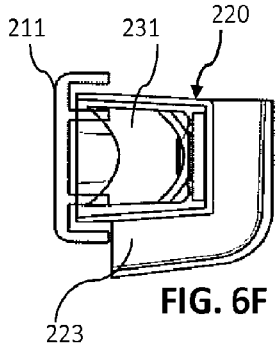
FIG. 6F is a cross-sectional view of the lamp assembly of FIG. 6A.
Figure 6D:
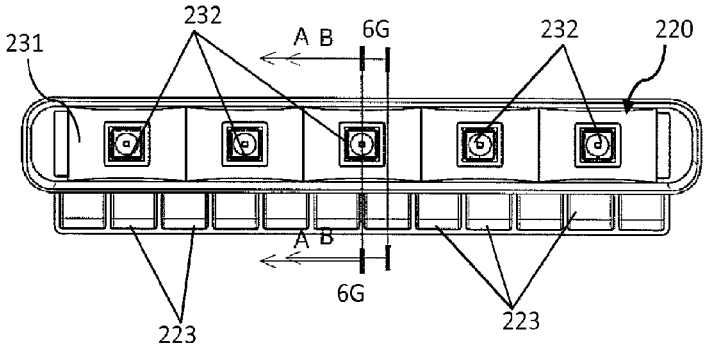
FIG. 6D is a frontal view of the lamp assembly of FIG. 6A.
Figure 6G:
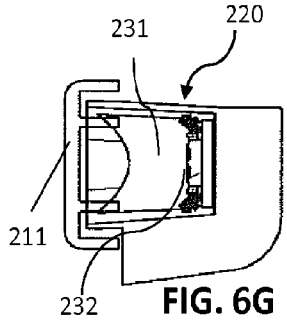
FIG. 6G is a cross-sectional view of the lamp assembly of FIG. 6A.
Figure 6E:
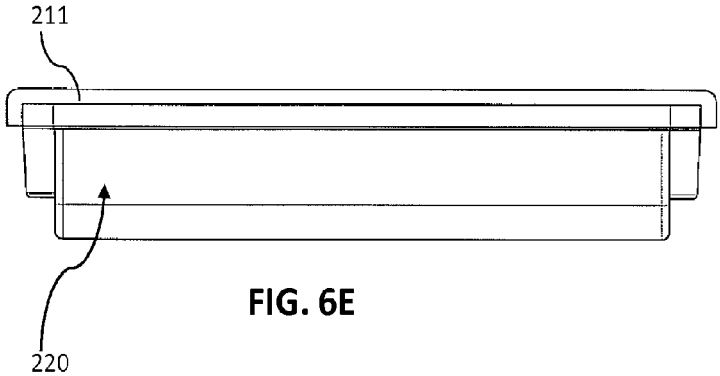
FIG. 6E is a bottom view of the lamp assembly of FIG. 6A.
Figure 6H:
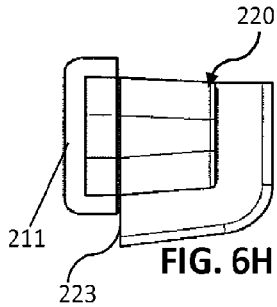
FIG. 6H is a right-side view of the lamp assembly of FIG. 6A.
Figure 6I:
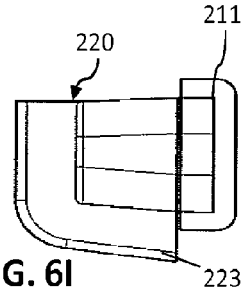
FIG. 6I is a left-side view of the lamp assembly of FIG. 6A.

In the embodiment of FIGS. 5 through 6I, the lamp housing 220 is formed to integrally include a plurality of such ducts 223. As shown in the embodiment of FIGS. 7 through 8H, ducts 323 such as described above may alternatively be formed in a separate element 325 defining a baffle that is secured to the lamp housing 320.

With reference now being had to FIGS. 9 through 10B and FIGS. 11 through 12B there are shown, respectively, embodiments of the inventive lamp assembly that are suited to employment as parking garage lights and street lights. Referring particularly to the exemplary parking garage light assembly 410 of FIGS. 9 through 10B, the same will be seen to comprise a lens 411, lamp 430 (comprising, in the illustrated embodiment, a plurality of LEDs 432 secured to a circuit board 433), and a lamp housing 420. Lamp housing 420 is formed to define a plurality of U-shaped ducts 423 in an upper surface thereof, as depicted, each such duct communicating at an outlet end with the ambient atmosphere (as shown best in FIGS. 9 and 10B). An opposite, inlet end of each duct 423 (see reference numerals 423 in FIG. 10A) is defined through the lamp housing 420 so as to communicate ducts 423 with the lamp chamber and so facilitate the dissipation of heat directly from the lamp chamber and out to the ambient atmosphere via ducts 423. A separate cover element 427 is secured over the top of lamp housing 420 to substantially cover the ducts 423 but for, as shown, the opposite outlet and inlet ends thereof. As will best be seen in FIG. 9, ducts 423 may further comprise a plurality of small fins 422 extending inwardly from the walls of the ducts to increase the surface area for heat dissipation/transfer purposes. Turning next to the exemplary street light assembly 510 of FIGS. 11 through 12B, the same will be seen to likewise comprise a lens 511, lamp 530 (comprising, in the illustrated embodiment, a plurality of LEDs 532 secured to a circuit board 533), and a lamp housing 520. Lamp housing 520 is formed to define a plurality of generally linear ducts 523 in an upper surface thereof, each such duct communicating at an outlet end with the ambient atmosphere, and at an opposite, inlet end with the lamp chamber defined in the housing 520 (see reference numerals 523 in FIG. 12B). A separate cover element 527 is secured over the top of lamp housing 520 to substantially cover the ducts 523. As shown, cover element 527 includes a single opening 528 communicating with the outlet ends of the ducts 523 to facilitate the dissipation of heat energy therethrough and to the ambient atmosphere. As will best be seen in FIG. 12A, ducts 523 may each further comprise a plurality of small fins 522 extending inwardly from the walls of the ducts to increase the surface area for heat dissipation/transfer purposes.

Where the lamp housing 220 is formed by other than MIM, such as by die casting or investment casting, for instance, the duct portion or portions 223 may be formed using internal mold slides and lifters.

In practice, the lamp assemblies of the present invention can, per an exemplary but non-limiting method, be made by first fabricating a lamp housing (e.g., 20, 120, 220) by MIM. This may, optionally, include making the lamp housing as a single, unitary—or monolithic—piece, and may also include the use of thixoforming, a sub-technique of MIM. A reflector portion (e.g., 131, 231), including, for instance, as described above, may be provided in the lamp housing in a position to reflect light emitted by the one or more lamps forward to the lens.

According to the embodiments described herein, the inventive lamp assembly is fashioned by the process of MIM, a conventional process employed to produce complex-shaped, three-dimensional precision metal parts without compromising strength. Generally speaking, the MIM process begins with the atomization of molten metal to form metal powders. The metal powder is subsequently mixed with thermoplastic binders to produce a homogeneous feedstock (approximately 60 volume % metal powder and 40 volume % binders). The feedstock is placed into an injection molder and molded at relatively low temperatures and pressures in conventional plastic injection molding machines to form a desired part. After injection molding, the binder is removed from the part by a process called "debinding." After debinding, the part is sintered at high temperatures, up to 2300 degrees F. (1260° C.), under a dry $H_2$ or inert gas atmosphere, to form a high-density metal part. In MIM, the complex shape of the molded part is retained throughout the process, so close tolerances can be achieved, and scrap is eliminated or significantly reduced as, machining of the part after sintering is usually unnecessary.

For magnesium and aluminum-magnesium alloys, a sub-technique of MIM, called thixoforming, is used. In thixoforming, ground, shaven, pelletized and/or other forms of magnesium or magnesium alloys are heated into a uniform semi-solid, thixotropic state; the material is then injected into a mold that is quite similar in design, scope and capability to those employed for plastic injection molding. The resulting magnesium injection-molded component is then removed from the die and trimmed as required.

Use of the foregoing approaches enables the effective increase of the density of the heat dissipating features compared to traditional molding methods such as die casting, given the process capabilities of the MIM and thixoformed molding technologies. Thereby, a greater cooling feature density may be achieved in a significantly smaller volume, thereby yielding a smaller, lighter weight and likely lower cost component.

Once the lamp housing has been formed, a lamp may then be mounted on the lamp housing, which may include mounting an LED on the lamp housing. Where an LED is used, the LED may be mounted on the circuit board and the circuit board mounted on the lamp housing. A lens may then be mounted on the lamp housing and may be arranged such that the lens cooperates with the lamp housing to at least partially define a lamp chamber that encloses the lamp. The lens may be mounted such that the lens and lamp housing cooperate to generally fluidly isolate the lamp chamber from the ambient atmosphere.

The lamp housing may be formed to include radiating elements such as fins and/or pins, etc., and/or ducts, all as heretofore described.

By the foregoing, the inventor hereof has developed a lamp assembly, for automotive as well as other applications, that is at once economical to manufacture and able to effectively dissipate heat energy generated by LEDs or other light sources.

The foregoing description of the exemplary embodiments of the invention have been presented in order to explain the principals of the innovation and its practical application so as to enable one skilled in the art to utilize the innovation. It is not intended to be exhaustive of, or to limit the invention to, the precise forms disclosed, and although only exemplary embodiments of the present invention have been described in detail in this disclosure, those skilled in the art who review this disclosure will readily appreciate that many modifications are possible to the present invention without materially departing from the novel teachings and advantages of the subject matter herein recited. Other substitutions, modifications, changes and omissions may be made in the exemplary embodiments without departing from the spirit of the present invention and, accordingly, all such modifications, changes, etc. are intended to be included within the scope of the invention as hereinafter claimed.

The invention claimed is:

1. A lamp assembly, comprising:

a lens;

a lamp housing in the form of an integral metal part, the lamp housing cooperating with the lens to at least partially define a lamp chamber that is generally fluidly isolated from an ambient atmosphere outside the lamp chamber;

at least one lamp provided in the lamp chamber and carried by the lamp housing;

wherein the lamp housing itself defines a heat sink exposed to the ambient atmosphere outside the lamp chamber such that heat from the at least one lamp is transmitted to the ambient atmosphere; and wherein the lamp housing is formed by metal injection molding.

2. A lamp assembly, comprising:

a lens;

a lamp housing in the form of an integral metal part, the lamp housing cooperating with the lens to at least partially define a lamp chamber that is generally fluidly isolated from an ambient atmosphere outside the lamp chamber;

at least one lamp provided in the lamp chamber and carried by the lamp housing;

wherein the lamp housing itself defines a heat sink exposed to the ambient atmosphere outside the lamp chamber such that heat from the at least one lamp is transmitted to the ambient atmosphere; and wherein the lamp housing is formed by thixoforming.

3. A method for making a lamp assembly, the method including the steps of:

making a lamp housing as an integral metal part;

mounting at least one lamp in the lamp housing; and mounting a lens on the lamp housing such that the lens cooperates with the lamp housing to at least partially define a lamp chamber that encloses the lamp, the lamp chamber being generally fluidly isolated from an ambient atmosphere outside the lamp chamber;

wherein the lamp housing itself defines a heat sink exposed to the ambient atmosphere outside the lamp chamber such that heat from the at least one lamp is transmitted to the ambient atmosphere; and wherein the step of making the lamp housing comprises making the lamp housing by metal injection molding.

4. A method for making a lamp assembly, the method including the steps of:

making a lamp housing as an integral metal part;

mounting at least one lamp in the lamp housing; and mounting a lens on the lamp housing such that the lens cooperates with the lamp housing to at least partially define a lamp chamber that encloses the lamp, the lamp chamber being generally fluidly isolated from an ambient atmosphere outside the lamp chamber;

wherein the lamp housing itself defines a heat sink exposed to the ambient atmosphere outside the lamp chamber such that heat from the at least one lamp is transmitted to the ambient atmosphere; and wherein the step of making the lamp housing comprises making the lamp housing by thixoforming.

* * * * *